US012181164B2

(12) United States Patent
Manoji et al.

(10) Patent No.: US 12,181,164 B2
(45) Date of Patent: Dec. 31, 2024

(54) SYSTEMS AND METHODS FOR SUNSHADE ADJUSTMENT

(71) Applicant: AIR DISTRIBUTION TECHNOLOGIES IP, LLC, Milwaukee, WI (US)

(72) Inventors: Akash Manoji, Pune (IN); Vikas Patil, Jaysingpur (IN); Amey Deepak Kulkarni, Pune (IN); Ashish Shoukat Naikwade, Pune (IN); Joseph S. Rockhold, Bates City, MO (US); Dino Randy Smith, Jr., Belton, MO (US); Ravindra Warake, Gadegaon (IN); Suvam Saha, Kolkata (IN); Melissa M. Massar, Lee's Summit, MO (US)

(73) Assignee: AIR DISTRIBUTION TECHNOLOGIES IP, LLC, Milwaukee, WI (US)

( * ) Notice: Subject to any disclaimer, the term of this patent is extended or adjusted under 35 U.S.C. 154(b) by 728 days.

(21) Appl. No.: 17/322,617

(22) Filed: May 17, 2021

(65) Prior Publication Data

US 2022/0364742 A1 Nov. 17, 2022

(51) Int. Cl.
*F24F 1/58* (2011.01)
*E04F 10/08* (2006.01)

(52) U.S. Cl.
CPC ..... *F24F 1/58* (2013.01); *E04F 10/08* (2013.01); *F24F 2221/16* (2013.01)

(58) Field of Classification Search
CPC ..... F24F 1/58; F24F 2221/16; E04F 10/08
USPC ..... 454/275
See application file for complete search history.

(56) References Cited

U.S. PATENT DOCUMENTS 4,220,137 A * 9/1980 Tesch ..... F24S 50/80 126/633
4,369,828 A * 1/1983 Tatro ..... E06B 9/264 160/107
8,528,621 B2 9/2013 Murphy et al.
8,678,067 B2 * 3/2014 Berezhnyy ..... H02S 20/30 160/1

(Continued)

FOREIGN PATENT DOCUMENTS

BE 1026474 A1 2/2020
DE 102015205936 A1 10/2015

OTHER PUBLICATIONS

Colt Group, "Solar Shading Louver Systems", Mestek Architectural, IntelligentEnvelopes, Mooresville, IN, last accessed May 17, 2021.

*Primary Examiner* — Allen R. B. Schult
(74) *Attorney, Agent, or Firm* — Michael Best & Friedrich LLP

(57) ABSTRACT

The present disclosure is directed to a sunshade system that monitors a position of the sun and adjusts a position of a frame and/or blades based on a position of the sun. For example, a heating, ventilation, and air conditioning (HVAC) unit of an HVAC system may be exposed to adverse, external weather conditions, such as sunlight, which may heat up components of the HVAC unit and decrease an efficiency of the HVAC system. Accordingly, a control system of the sunshade system may monitor the position of the sun and adjust the position of the frame and/or the blades to provide adequate shading for the HVAC unit.

20 Claims, 7 Drawing Sheets

(56) References Cited

U.S. PATENT DOCUMENTS

| | | | | |
|---|---|---|---|---|
| 9,470,040 | B2 * | 10/2016 | Hall | E06B 9/303 |
| 2020/0217124 | A1 * | 7/2020 | Bernhagen | E05D 15/58 |

* cited by examiner

SYSTEMS AND METHODS FOR SUNSHADE ADJUSTMENT

BACKGROUND

This section is intended to introduce the reader to various aspects of art that may be related to the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and/or air conditioning (HVAC) systems are utilized in residential, commercial, and industrial applications to control environmental properties, such as temperature and humidity, for occupants of respective environments. The HVAC system may control the environmental properties through control of an air flow delivered to and ventilated from spaces serviced by the HVAC system. For example, the HVAC system may transfer heat between the air flow and refrigerant flowing through the system. It is now recognized that, in many HVAC systems, sunlight and external weather may affect internal conditions of a building.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a sunshade system includes a frame configured to move in at least one degree of freedom and a plurality of blades coupled to the frame. Each blade of the plurality of blades is configured to rotate relative to the frame. The sunshade system also includes a motor configured to adjust a position of the frame or rotate the plurality of blades relative to the frame. Further, the sunshade system includes a sensor configured to monitor a solar position and generate solar position data based on the monitored solar position. The sunshade system also includes a controller communicatively coupled to the motor. The controller is configured to receive the solar position data from the sensor and instruct the motor to adjust the position of the frame or rotate the plurality of blades based on the solar position data.

In another embodiment, a method is provided for controlling positioning of a sunshade of a heating, ventilation, and/or air conditioning (HVAC) system including monitoring, via one or more sensors, a solar position and a sunshade position. The method also includes generating, via a controller, solar position data based on the monitored solar position and generating, via the controller, sunshade position data based on the monitored sunshade position. Further, the method includes instructing, via the controller, a motor to adjust a position of a frame of the sunshade based on the solar position data and the sunshade position data, wherein a plurality of blades are coupled to the frame, each blade of the plurality of blades configured to rotate relative to the frame.

In another embodiment, a sunshade system of a heating, ventilation, and/or air conditioning (HVAC) system includes a frame configured to move in at least one degree of freedom and a plurality of blades coupled to the frame. Each blade of the plurality of blades is configured to rotate relative to the frame. The sunshade system also includes a first actuator configured to adjust a position of the frame and a second actuator configured to rotate the plurality of blades relative to the frame. The sunshade system also includes a sensor configured to monitor a solar position and generate solar position data based on the monitored solar position. The sunshade system further includes a controller communicatively coupled to the first actuator and the second actuator. The controller is configured to receive the solar position data from the sensor, instruct the first actuator to adjust the position of the frame based on the solar position data and a position of an HVAC component to shade, and instruct the second actuator to rotate the plurality of blades relative to the frame based on the solar position data.

BRIEF DESCRIPTION OF THE DRAWINGS

Various objects, aspects, features, and advantages of the disclosure will now become more apparent and better understood by referring to the detailed description taken in conjunction with the accompanying drawings, in which like reference characters identify corresponding elements throughout. In the drawings, like reference numbers generally indicate identical, functionally similar, and/or structurally similar elements.

DETAILED DESCRIPTION

Figure 1:
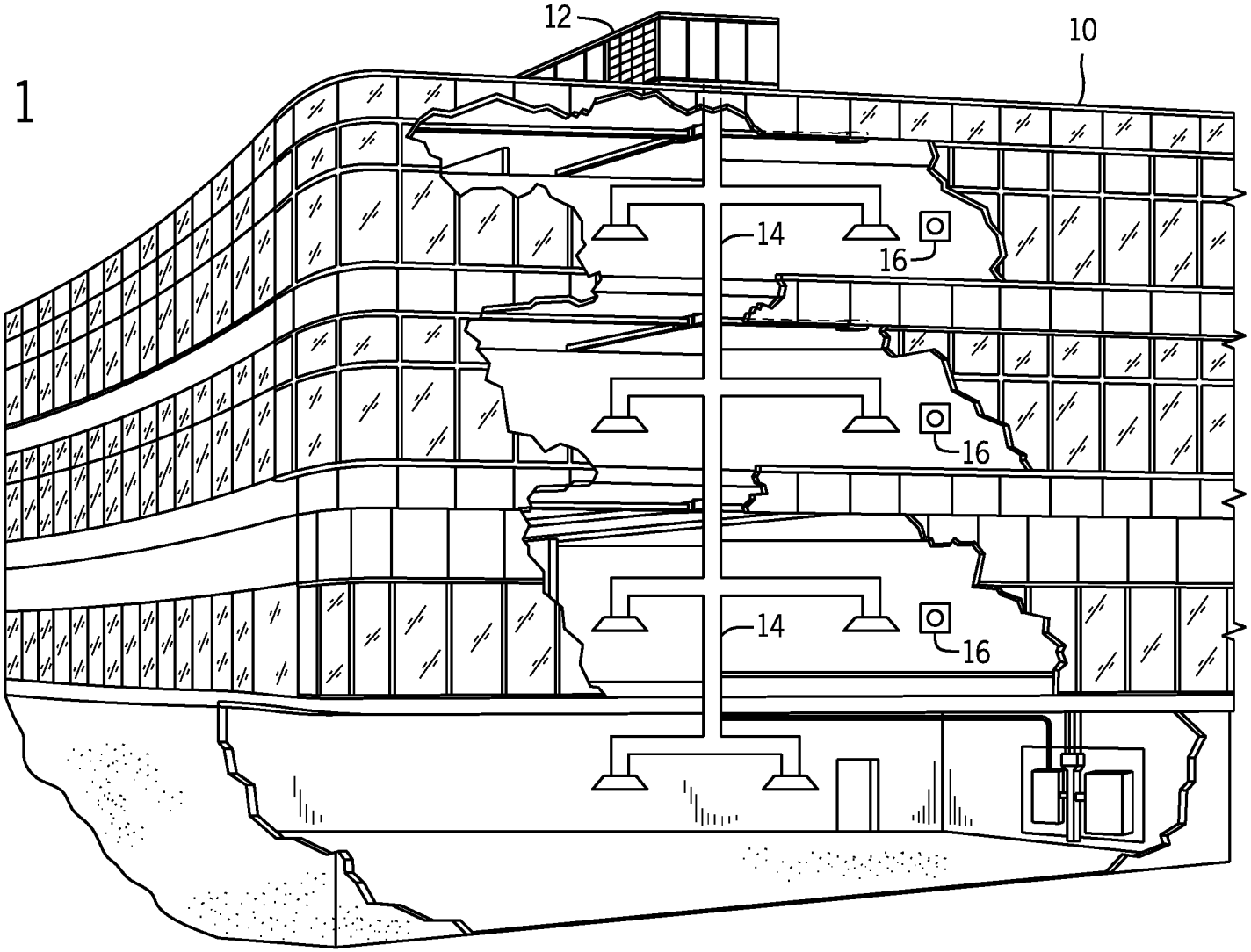
FIG. 1 is a perspective view of an embodiment of a heating, ventilation, and/or air conditioning (HVAC) system for environmental management that may employ one or more HVAC units, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terminals "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure is directed to a sunshade system that monitors a position of the sun and adjusts a position of a frame and/or blades based on a position of the sun. For example, a heating, ventilation, and/or air conditioning (HVAC) unit of an HVAC system may be exposed to adverse, external weather conditions, such as sunlight, which may heat up components of the HVAC unit and decrease an efficiency of the HVAC system. Accordingly, a control system of the sunshade system may monitor the position of the sun and adjust the position of the frame and/or the blades to provide adequate shading for the HVAC unit. Similarly, if weather conditions of the external environment are favorable, the control system may adjust the position of the frame and/or the blades to permit the weather to affect components of the HVAC unit in a beneficial manner. As another example, in some instances, building occupants may have sunshades over windows set to allow external weather conditions, such as sunlight, to heat up portions of the building above a set-point temperature, which may decrease an efficiency of a heating, ventilation, and air conditioning (HVAC) system. Accordingly, the control system may adjust the position of the frame and/or the blades to block or restrict the weather of the external environment from impacting internal conditions of the building in an undesirable manner. Similarly, the control system may operate in accordance with present embodiments to encourage influence on internal temperatures by the external environment, such as by adding warming from the sun when internal temperatures are lower than desired. Thus, the weather conditions may be utilized to help increase an efficiency of the HVAC system by providing adequate shading for an HVAC unit, permitting sunlight to enter and heat the building, blocking sunlight from the building, and so forth.

Turning now to the drawings, FIG. 1 illustrates an embodiment of a heating, ventilation, and/or air conditioning (HVAC) system for environmental management that may employ one or more HVAC units. Each of these HVAC units and the building itself (e.g., along windows of the building) may incorporate a sunshade system in accordance with present embodiments. These may each share a central controller or have individual controllers, which may include an automation controller, programmable logic controller, or the like.

As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10. In an embodiment, the control device 16 may include a controller that operates to monitor data related to a position of the sun and control a sunshade of the HVAC unit.

Figure 2:
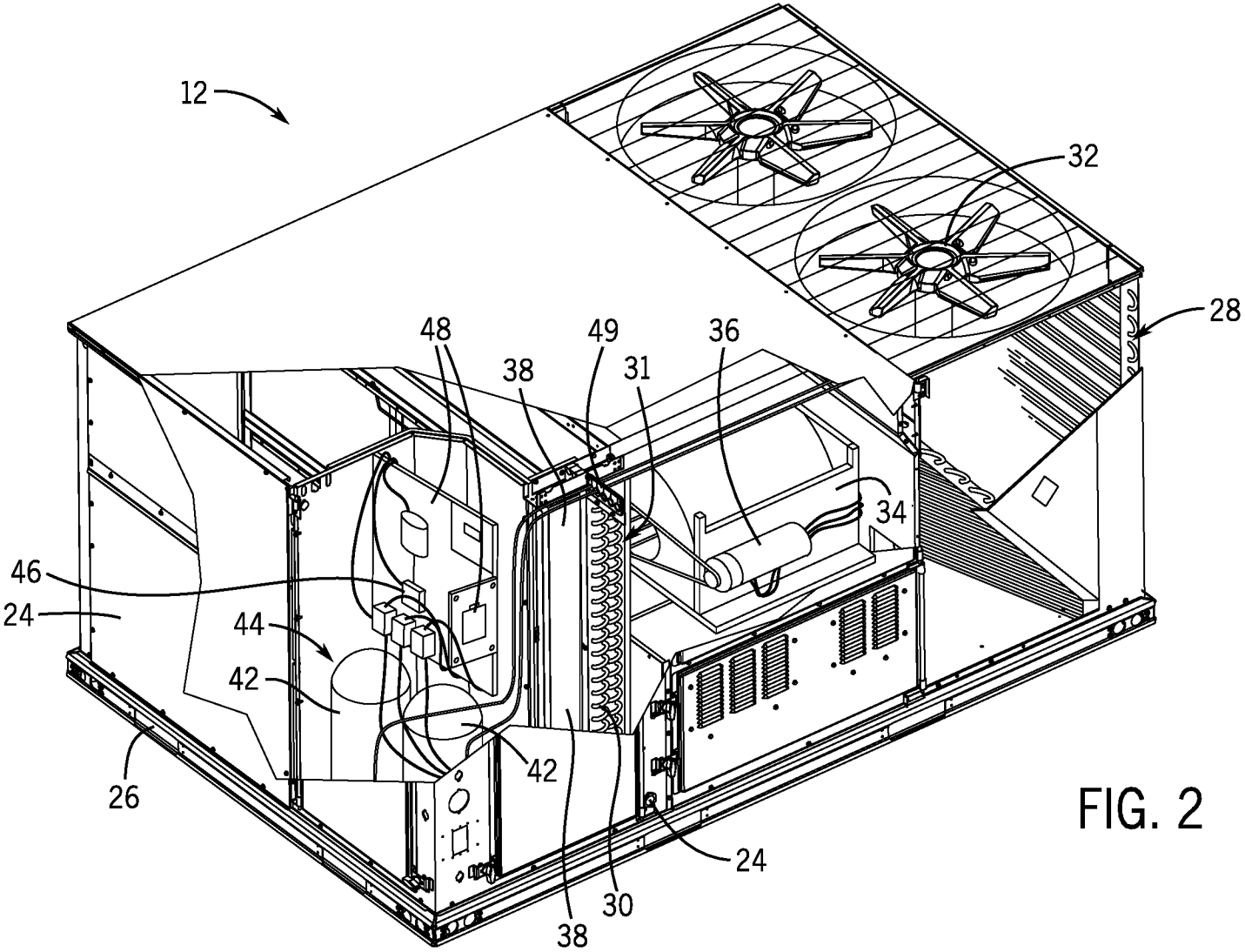
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heating, cooling with dehumidification, cooling with gas heating, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. The cabinet 24 may also include and/or incorporate the sunshade system, which includes adjustable components for dynamic shading. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead member rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant through the heat exchangers 28 and 30. For example, the refrigerant may be R-410A. The tubes may be of various types, such as multichannel and/or microchannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
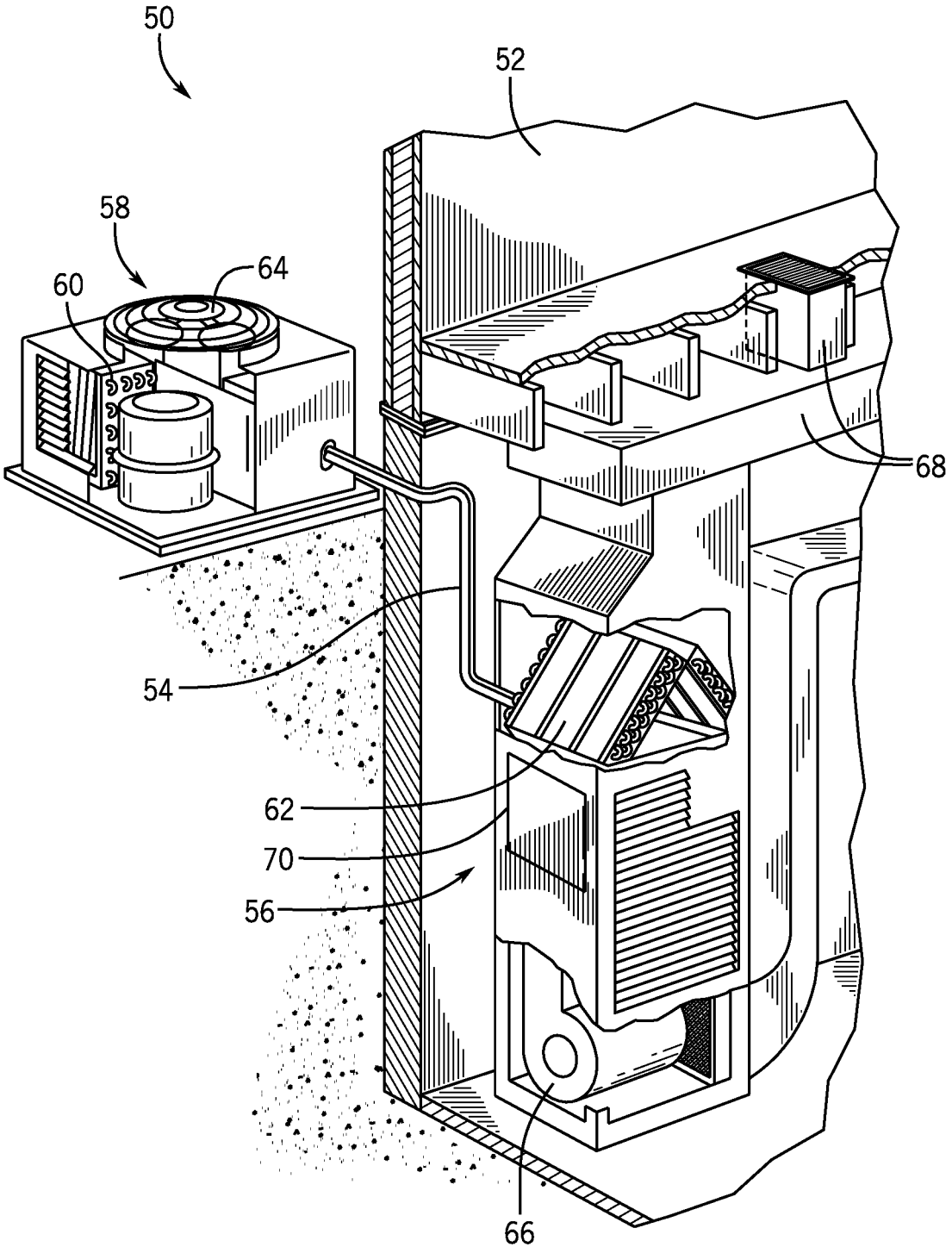
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. The residential heating and cooling system 50 incorporates a sunshade system to increase efficiency whether in a heating mode or a cooling mode. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered.

The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
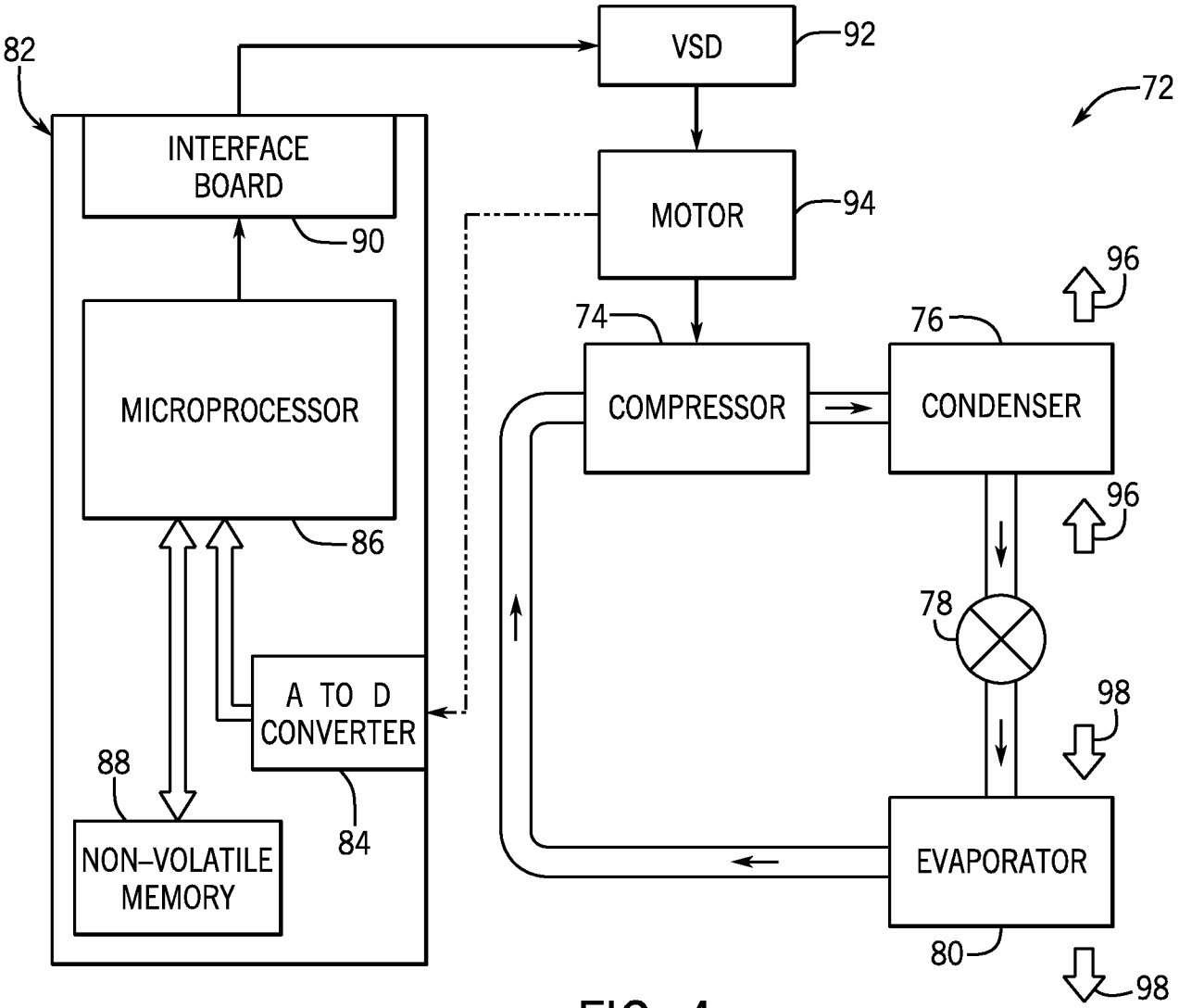
FIG. 4 is a schematic view of an embodiment of a vapor compression system that may be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth. The control panel 82 may also include and control the sunshade system to create operational efficiencies when managing environmental conditions.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor. In an embodiment, power from the motor 94 may also be used to activate the sunshade (as generally represented by the control panel 82).

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

Any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
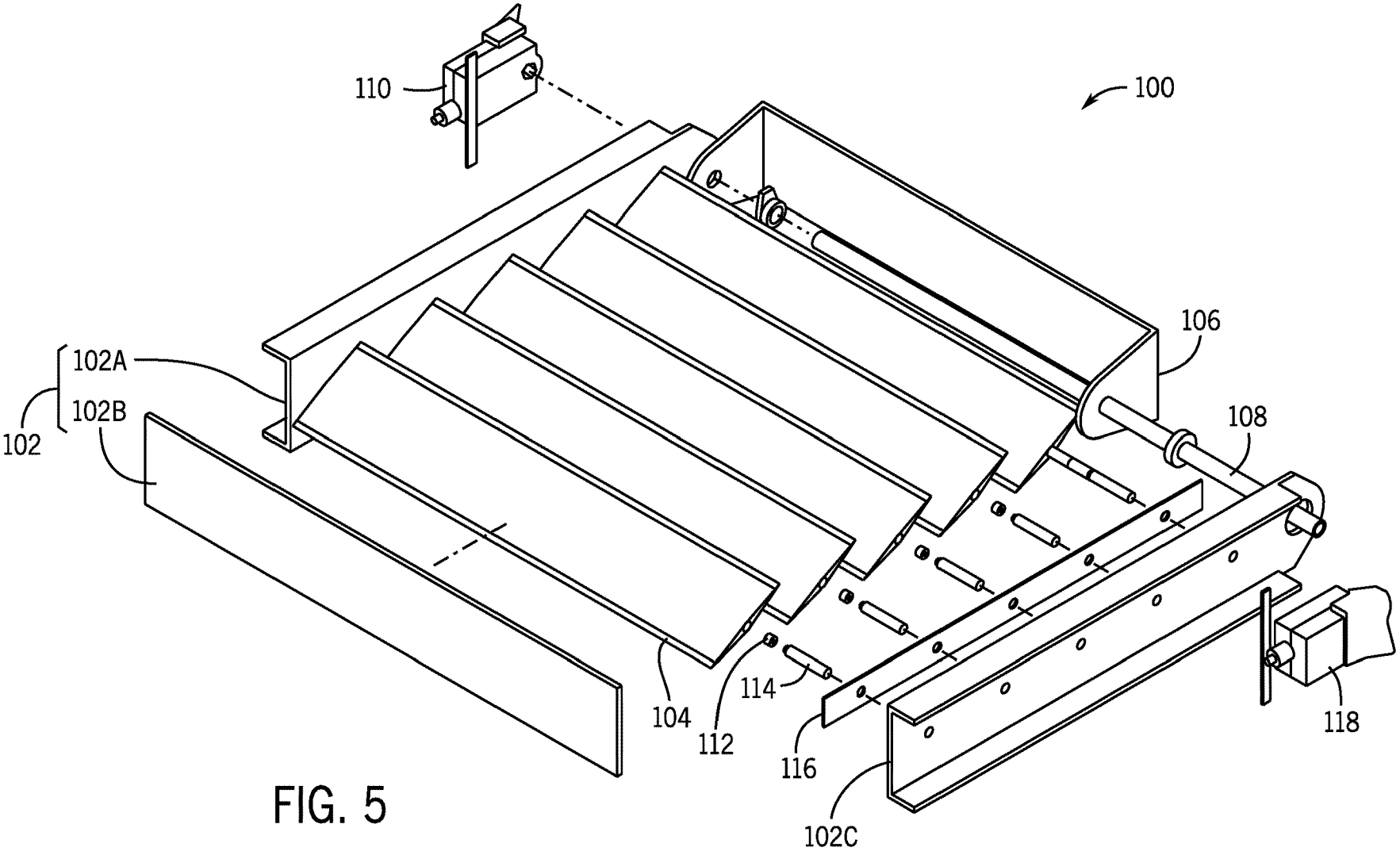
FIG. 5 is a perspective view of an embodiment of a sunshade system, in accordance with an aspect of the present disclosure.

A sunshade system may shield the HVAC unit 12 and may increase an efficiency of the HVAC system by restricting or preventing adverse external conditions from affecting components of the HVAC unit 12 and/or by allowing favorable external conditions from affecting the components of the HVAC unit 12. For example, the HVAC unit 12 may include one or more heat exchangers across which an air flow is passed to condition the air flow before the air flow is supplied to the building. During a sunny or warm day, the sunshade system may shade the one or more heat exchangers to reduce unintended heat transfer from refrigerant to the external environment. When operating in a heating mode, the sunshade system may expose or permit sunlight to impact components of the HVAC unit 12 to provide desired heat transfer (e.g., radiative heating) to heat exchangers and/or supply air for the HVAC unit 12. FIG. 5 illustrates a sunshade system 100 that may be incorporated with the HVAC unit 12, the residential heating and cooling system 50, or other HVAC systems. The sunshade system 100 may include a frame 102 and any number of blades 104 disposed at least partially within the frame 102 and/or rotationally coupled to the frame 102. In certain embodiments, the frame 102 may include any number of sections (e.g., first section 102A, second section 102B, third section 102C). The frame 102 may be rotationally coupled to an HVAC unit, such as the HVAC unit 12, by a mount 106. For example, the frame 102 may pivot relative to the HVAC unit 12 and/or the mount 106. The mount 106 may have one or more apertures formed therethrough for receiving a shaft 108. The first section 102A and the third section 102C may have apertures formed therethrough for receiving opposite ends of the shaft 108. The shaft 108 may rotate relative to the mount 106 and may engage and may cause the frame 102 to rotate. For example, a first motor 110 may receive an end of the shaft 108 and may rotate the shaft 108 relative to the mount 106. The shaft 108 may be coupled to the frame (e.g., at first section 102A and/or second section 102B). As such, the first motor 110 may rotate the frame 102 via the shaft 108. In certain embodiments, the frame 102 may rotate through a range of angles (e.g., 0-30 degrees, 0-45 degrees, 0-90 degrees, and so forth).

The blades 104 may be partially disposed within the frame 102 and may rotate relative to the frame 102, as described further below. In certain embodiments, the blades 104 may rotate up to 180 degrees relative to the frame 102 (e.g., up to 90 degrees, up to 45 degrees, and so forth). For example, each blade 104 may respectively rotate about a longitudinal axis 112 of the blade 104. The blades 104 may be coupled to one or more portions of the frame 102. For example, each blade 104 may include an aperture that receives a corresponding pin 114 and the pin 114 may be received in an aperture of the third section 102C of the frame 102. Each blade may include a second aperture at an opposite end from the aperture that receives the pin 114 and the second aperture may receive a second pin that couples the blade 104 to the first section 102A of the frame 102. Alternatively, each blade 104 may include a single aperture that spans a length of the blade 104 along the longitudinal axis 112 and the pin 114 may extend through the aperture and couple the blade 104 to the first section 102A and the third section 102C of the frame 102. Each pin 114 may couple to a linkage 116. For example, the linkage 116 may include a rectangular strip having a number of apertures formed therethrough corresponding to each pin 114.

The linkage 116 may be coupled to the second motor 118 and the second motor 118 may move the linkage 116. As such, the linkage 116 may couple each of the blades 104 to the second motor 118 via the pins 114. The linkage 116 may function as would be understood in the art. For example, the linkage 116 may include multiple moving components that couple with the blades 104 (directly or indirectly) to facilitate movement of the blades, particularly rotation of the blades, based on movement of the linkage 116 (e.g., movement of linkage components relative to one another). In certain embodiments, the second motor 118 may rotate each of the blades 104 at the same time via the linkage 116. Additionally or alternatively, each blade 104 may be independently movable relative to any other blade 104. As such, the sunshade system 100 may adjust (e.g., rotate the frame 102 and/or the blades 104) to allow through an appropriate amount of light, air, rain, and/or any other suitable environmental effect. Alternatively, a single motor may rotate the frame 102 and the blades 104. The first motor 110 and the second motor 118 may be any suitable actuator capable of adjusting the position of the frame 102 and/or the blades 104, such as any type of electric motor that can be powered by a VSD or directly from an AC or DC power source, such as a switched reluctance motor, an induction motor, an electronically commutated permanent magnet motor, or another suitable motor.

Figure 6:
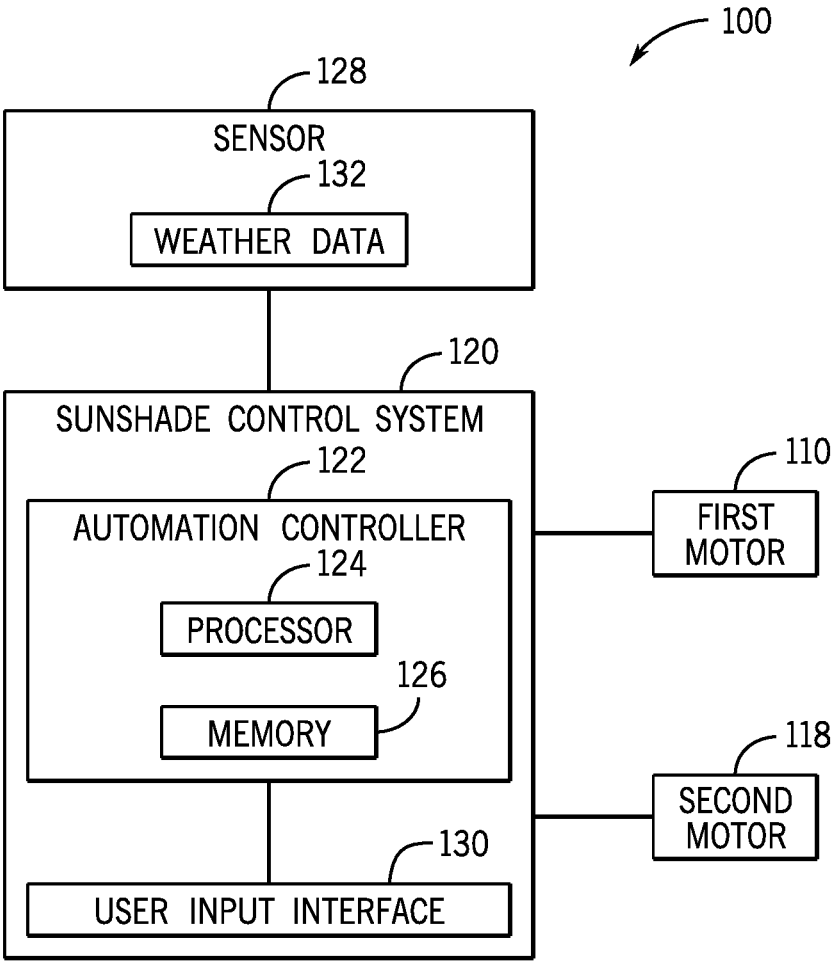
FIG. 6 is a block diagram of the sunshade system of FIG. 5, in accordance with an aspect of the present disclosure.

A control system may monitor external weather conditions to determine appropriate positions of the frame 102 and/or the blades 104 to achieve a desired result. For example, the control system may determine a position of the sun and/or a position of components of the HVAC unit 12 and adjust the positions of the frame 102 and/or the blades 104 based on the position of the sun and/or the position of the components to reduce or increase an impact of the sun on certain HVAC components. FIG. 6 illustrates a block diagram of an embodiment of the sunshade system 100 that may be utilized to adjust the blades 104 and/or the frame 102 based on weather data, such as a position of the sun. The sunshade system 100 may include the motors 110, 118, a sunshade control system 120, and a sensor 128. The sunshade control system 120 may be a control system having multiple controllers, such as automation controller 122, each having at least one processor 124 and at least one memory 126. The sunshade control system 120 may represent a unified hardware component or an assembly of separate components integrated through communicative coupling (e.g., wired or wireless communication). For example, the sunshade control system 120 may be any suitable control device, such as a thermostat. It should be noted that, in some embodiments, the sunshade control system 120 may include the sensor 128 and may be operable to communicate with a local display on a particular computing device. With respect to functional aspects of the sunshade control system 120, the automation controller 122 may use information from the sensor 128 (e.g., weather data 132), information about a position of components of the HVAC unit 12, and/or information from the motors 110, 118 (e.g., blade position data, frame position data) to adjust a position of the frame 102 and/or the blades 104 based on a position of the sun, an outside temperature, a wind speed, a precipitation amount, a light intensity, and/or any other suitable weather information. It should be noted that the motors 110, 118 may represent a single motor that utilizes different engagement features (e.g., a clutch) to control positioning of the frame 102 and/or the blades 104. Further, the motors 110, 118 may cooperate with or obtain power from other motors of an HVAC system.

In some embodiments, the memory 126 may include one or more tangible, non-transitory, computer-readable media that store instructions executable by the processor 124 (representing one or more processors) and/or data to be processed by the processor 124. For example, the memory 126 may include random access memory (RAM), read only memory (ROM), rewritable non-volatile memory such as flash memory, hard drives, optical discs, and/or the like. Additionally, the processor 124 may include one or more general purpose microprocessors, one or more application specific processors (ASICs), one or more field programmable gate arrays (FPGAs), or any combination thereof. Further the memory 126 may store weather data 132 obtained via the sensor 128, component position data about the positions of HVAC components of the HVAC unit 12, blade position data and/or frame position data obtained via the motors 110, 118, and/or algorithms utilized by the processor 124 to help control operation of the first motor 110 and/or the second motor 118 based on the weather data 132. Additionally, the processor 124 may process weather data 132 to determine a position of the sun and may process frame position data and/or blade position data to determine a current position of the frame 102 and/or the blades 104. In certain embodiments, the sunshade control system 120 may include additional elements not shown in FIG. 1, such as additional data acquisition and processing controls, additional sensors and displays, user interfaces, and so forth.

The sensor 128 may detect, sense, and/or measure weather data 132 that may include a light intensity and/or a position of the sun. For example, the sensor 128 may monitor a position of the sun and may generate solar position data based on the position of the sun. In certain embodiments, the sensor 128 may be a light sensor capable of detecting a light intensity. Thus, the sensor 128 may directly monitor the position of the sun and also measure an intensity of the sun at a particular time. Intensity measures may be utilized to gauge how much blocking or opening is desired to achieve a result. For example, the sun may be considered less intense on a day with heavy cloud cover than on a day with no clouds, and, thus, differing amounts of sunshade activity may be desired based on a desired outcome. Additionally or alternatively, the sensor 128 may be capable of determining a location of the sunshade control system 120 and utilizing this location data with available astronomy data to determine a relative position of the sun. For example, the sensor 128 may be a Global Positioning System (GPS) device capable of determining and generating location data and may transmit the location data to the sunshade control system 120. Because the sun's position relative to the position of Earth is capable of accurate prediction, lookup tables, a database, or website access may be employed by the sunshade control system 120 to identify positioning of the sun. The sensor 128 may be communicatively coupled to the automation controller 122, such as a wireless, optical, coaxial, or other suitable connection. As such, the sensor 128 may transmit weather data 132 and/or location data (e.g., after collecting it from sensors, GPS devices, network data) to the automation controller 122 to be processed by suitable processing circuitry, such as the processor 124.

The automation controller 122 may also control or coordinate with the sensor 128, which may be operated to ascertain weather data 132 and/or location data for the sunshade control system 120. As a specific example, the sensor 128 may be a GPS device that operates to determine location data for the sunshade control system 120. The automation controller 122 may receive location data and process the location data to determine a location of the sunshade control system 120 (e.g., global positioning coordinates, latitude, longitude, elevation, and so forth) and may process the location data. For example, the automation controller 122 may determine a time, a date, and a location of the sunshade control system 120 based on the location data. The automation controller 122 may also determine a position of the sun based on the location data. For example, the automation controller 122 may determine the position of the sun based on the time, the date, and the location of the sunshade control system 120. Additionally or alternatively, the automation controller 122 may also determine positions of components of an HVAC system. For example, the automation controller 122 may access a layout of the HVAC unit 12 stored on the memory 126 and may determine a position of components (e.g., fan, heat exchanger(s), heater, air flow control device, filter, and so forth) relative to the position of the sun. As such, when operating in a cooling mode, the automation controller 122 may determine a heat exchanger is positioned on a sunward side of the HVAC unit 12 and may operate the motors 110, 118 to adjust the frame 102 and/or the blades 104 to provide shade for the heat exchanger. As another example, when operating in a heating mode, the automation controller 122 may determine an air flow control device providing supply air to the HVAC system is positioned on the sunward side of the HVAC unit 12 and may operate the motors 110, 118 to adjust the frame 102 and/or the blades 104 to allow sunlight (e.g., radiative heating) to the air flow control device and supply air.

In some embodiments, the automation controller 122 may generate and may monitor actuator control data for the motors 110, 118 and may determine a position and/or an orientation of the frame 102 and/or the blades 104. For example, the automation controller 122 may determine a position of the sun relative to an orientation of the frame 102 and/or the blades 104. The automation controller 122 may control operation of the first motor 110 and/or the second motor 118, which may rotate the frame 102 and/or the blades 104 based on the position of the sun. For example, the automation controller 122 may instruct the first motor 110 to rotate the frame 102 relative to the mount 106 and/or may instruct the second motor 118 to rotate the blades 104 relative to the frame 102. As such, the automation controller 122 may instruct the motors 110, 118 to adjust the frame 102 and/or the blades 104 and, thereby, control an amount of sunlight and/or light intensity and provide effective shading for an HVAC system.

Additionally or alternatively, the automation controller 122 may include a user input interface 130 capable of receiving an input from a user to adjust a position of the frame 102 and/or a position of the blades 104. In certain embodiments, the user input interface 130 may be a portion of a display, such as touchscreen display, that may provide an indication of an operating mode of the sunshade control system 120. For example, a user may select a manual operating mode (e.g., a user may input a position of the frame 102 and/or the blades 104) or an automatic operating mode (e.g., the automation controller 122 may instruct the motors 110, 118 to adjust the position of the frame 102 and/or the blades 104 based on the solar position data). While the illustrated embodiment of FIG. 6 shows the sunshade control system 120 controlling two motors 110, 118, in other embodiments, the sunshade control system 120 may control any number of motors to adjust any number of frames 102 and/or blades 104.

Figure 7:
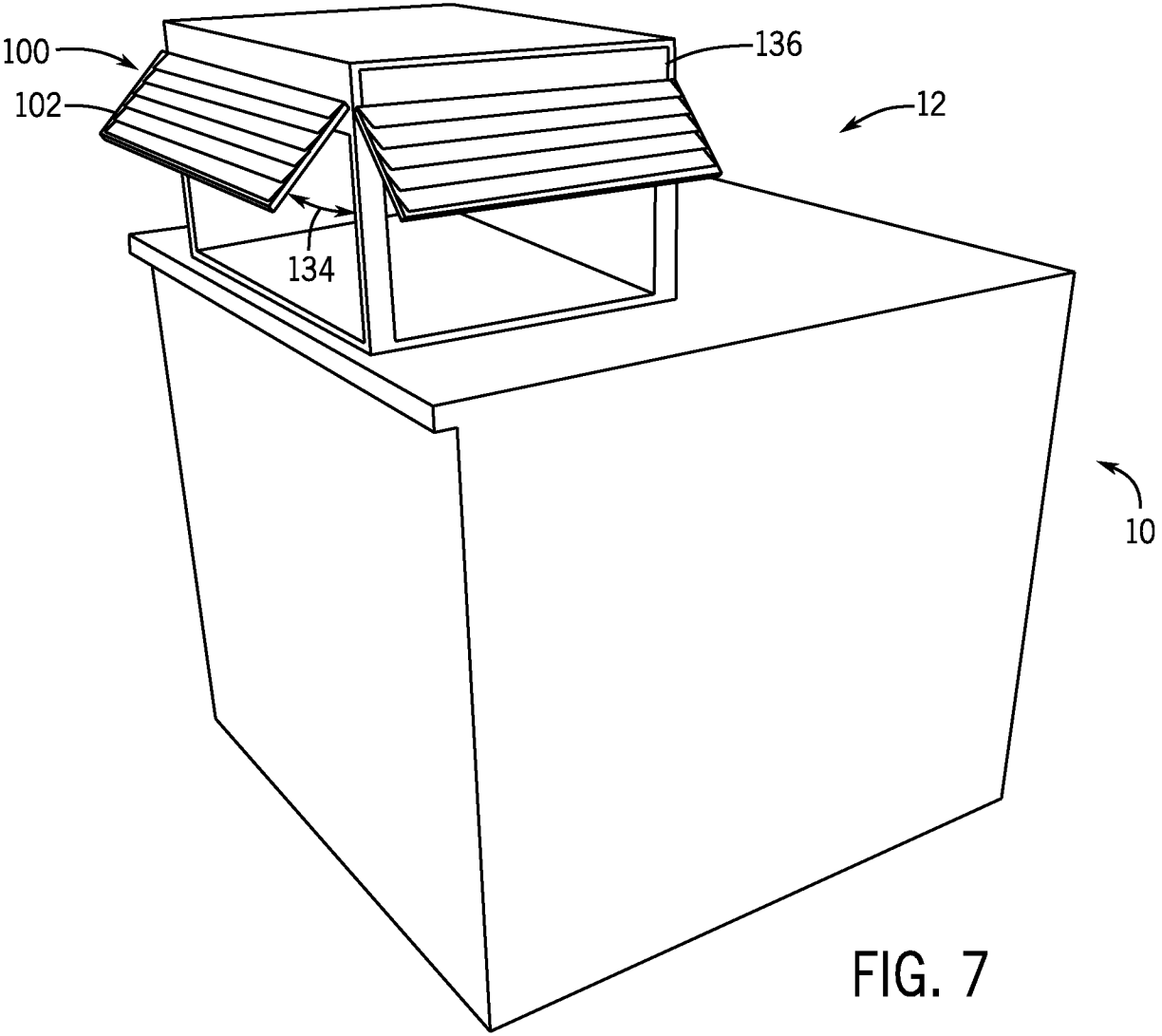
FIG. 7 is a perspective view of an HVAC unit that may utilize the sunshade system of FIG. 5, in accordance with an aspect of the present disclosure.

An HVAC system, such as the HVAC unit 12, the residential heating and cooling system 50, and/or the vapor compression system 72, may utilize a sunshade system, such as the sunshade system 100, to adjust the position of the frame 102 and/or the blades 104 to increase an efficiency of the HVAC system in conditioning a space within a building, such as by providing effective shading of an outdoor unit. FIG. 7 illustrates a perspective view of the HVAC unit 12 incorporating the sunshade system 100. The HVAC unit 12 may include any number of sunshade systems 100. The frame 102 may rotate through a range 134 of angles (e.g., −30 degrees, 0-45 degrees, 0-90 degrees, and so forth). For example, the frame 102 may rotate away from the HVAC unit 12 and provide additional shading to the building 10 and/or the HVAC unit 12. Further, the sunshade system 100 may include a turntable 136 that allows for rotation about a vertical axis to position the frame 102 and blades in different positions about the axis based on a relative position of the sun or other environmental conditions.

One or more of the disclosed embodiments, alone or in combination, may provide one or more technical effects useful in increasing an efficiency of an HVAC system. For example, presently disclosed embodiments enable a sunshade system to provide effective shading for an HVAC system. In general, presently disclosed embodiments may improve efficiency and cost savings relative to traditional embodiments.

While only certain features and embodiments of the disclosure have been illustrated and described, many modifications and changes may occur to those skilled in the art, such as variations in sizes, dimensions, structures, shapes, and proportions of the various elements, values of parameters including temperatures and pressures, mounting arrangements, use of materials, colors, orientations, etc., without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort, to provide a concise description of the exemplary embodiments, all features of an actual implementation may not have been described, such as those unrelated to the presently contemplated best mode of carrying out the disclosure, or those unrelated to enabling the claimed disclosure. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designed as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A sunshade system of a heating, ventilation, and/or air conditioning (HVAC) system, comprising:

a frame configured to move in at least one degree of freedom relative to an HVAC component of the HVAC system;

a plurality of blades coupled to the frame, wherein each blade of the plurality of blades is configured to rotate relative to the frame;

a motor configured to adjust a position of the frame or rotate the plurality of blades relative to the frame;

a sensor configured to monitor a solar position and generate solar position data based on the monitored solar position; and a controller communicatively coupled to the motor, wherein the controller is configured to:

receive the solar position data from the sensor; and instruct the motor to adjust the position of the frame or rotate the plurality of blades based on the solar position data and a relative position of the HVAC component to either shield the HVAC component from solar rays or to expose the HVAC component to solar rays, based on an operating condition of the HVAC component.

2. The sunshade system of claim 1, comprising a linkage coupled to the motor and coupled to each blade of the plurality of blades, wherein the motor is configured to move the linkage to rotate the plurality of blades.

3. The sunshade system of claim 1, wherein the motor is configured to rotate the frame in at least a ninety degree range.

4. The sunshade system of claim 1, wherein the sensor comprises one or more sensors configured to generate the solar position data based on the solar position relative to an orientation of the frame, an orientation of the plurality of blades, or both.

5. The sunshade system of claim 1, wherein the motor is configured to rotate each blade of the plurality of blades in at least a ninety degree range.

6. The sunshade system of claim 1, wherein the sensor includes a Global Positioning System (GPS) device.

7. The sunshade system of claim 1, wherein the controller is configured to:

receive a user input indicative of an instruction to move the frame to a second position; and instruct the motor to move the frame to the second position based on the user input.

8. The sunshade system of claim 1, comprising a second motor configured to rotate the plurality of blades relative to the frame.

9. The sunshade system of claim 8, wherein the controller is configured to instruct the second motor to rotate the plurality of blades relative to the frame based on the solar position data.

10. The sunshade system of claim 1, comprising a turntable configured to rotate the frame about a vertical axis.

11. The sunshade system of claim 1, wherein the motor is configured to adjust the position of the frame and rotate the plurality of blades relative to the frame.

12. A method of controlling positioning of a sunshade of a heating, ventilation, and/or air conditioning (HVAC) system, comprising:

monitoring, via one or more sensors, a solar position and a sunshade position;

generating, via a controller, solar position data based on the monitored solar position and sunshade position data based on the monitored sunshade position; and instructing, via the controller, a motor to adjust a position of a frame of the sunshade based on the solar position data, a relative position of an HVAC component of the HVAC system, and the sunshade position data to either shield the HVAC component from solar rays or to expose the HVAC component to solar rays, based on an operating condition of the HVAC component, wherein a plurality of blades are coupled to the frame, each blade of the plurality of blades configured to rotate around an axis through a center of each blade of the plurality of blades relative to the frame.

13. The method of claim 12, comprising instructing, via the controller, the motor to rotate the plurality of blades based on the solar position data and the relative position of the HVAC component of the HVAC system to shield the HVAC component from solar rays.

14. The method of claim 12, wherein the solar position data comprises a solar position relative to an orientation of the frame.

15. The method of claim 12, wherein the solar position data comprises a solar position relative to an orientation of the plurality of blades.

16. The method of claim 12, wherein at least one sensor of the one or more sensors is a light intensity sensor.

17. The method of claim 16, comprising monitoring, via the light intensity sensor, a light intensity of the sun.

18. The method of claim 17, comprising instructing, via the controller, the motor to adjust the position of the frame of the sunshade based on the light intensity.

19. The method of claim 12, comprising instructing, via the controller, the motor to adjust a position of at least one blade based on the solar position data.

20. A sunshade system of a heating, ventilation, and/or air conditioning (HVAC) system, comprising:

a frame configured to move in at least one degree of freedom relative to an HVAC component of the HVAC system;

a plurality of blades coupled to the frame, wherein each blade of the plurality of blades is configured to rotate relative to the frame;

a first actuator configured to adjust a position of the frame;

a second actuator configured to rotate the plurality of blades relative to the frame;

a sensor configured to monitor a solar position and generate solar position data based on the monitored solar position; and a controller communicatively coupled to the first actuator and the second actuator, wherein the controller is configured to:

receive the solar position data from the sensor;

instruct the first actuator to adjust the position of the frame based on the solar position data and a position of the HVAC component; and instruct the second actuator to rotate the plurality of blades relative to the frame based on the solar position data and a relative position of the HVAC component to either shield the HVAC component from solar rays or to expose the HVAC component to solar rays, based on an operating condition of the HVAC component.

* * * * *